US008191515B2

(12) United States Patent
Kontani et al.

(10) Patent No.: US 8,191,515 B2
(45) Date of Patent: Jun. 5, 2012

(54) V-TYPE INTERNAL COMBUSTION ENGINE INCLUDING THROTTLE VALVE DEVICE, AND VEHICLE INCORPORATING SAME

(75) Inventors: Masahiro Kontani, Saitama (JP); Takashi Yokoyama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 698 days.

(21) Appl. No.: 12/386,555

(22) Filed: Apr. 20, 2009

(65) Prior Publication Data

US 2009/0314231 A1 Dec. 24, 2009

(30) Foreign Application Priority Data

Jun. 24, 2008 (JP) ..... 2008-164353
Jun. 24, 2008 (JP) ..... 2008-164593

(51) Int. Cl.
*F02B 75/22* (2006.01)

(52) U.S. Cl. ..... 123/54.4; 123/195 R; 123/90.15; 123/184.31

(58) Field of Classification Search ..... 123/195 R, 123/90.15, 54.4
See application file for complete search history.

(56) References Cited

U.S. PATENT DOCUMENTS 6,073,603 A * 6/2000 Sumi et al. ..... 123/195 AC
6,220,109 B1 4/2001 Fischer et al.
6,374,691 B1 4/2002 Grundberg
7,380,534 B2 * 6/2008 Sekimoto ..... 123/198 E
8,020,531 B2 * 9/2011 Maehara et al. ..... 123/399
2006/0213475 A1 * 9/2006 Sekimoto ..... 123/184.35
2007/0044744 A1 * 3/2007 Kono et al. ..... 123/90.16
2008/0078349 A1 * 4/2008 Kudo et al. ..... 123/184.34
2008/0156283 A1 * 7/2008 Hasebe et al. ..... 123/54.4

FOREIGN PATENT DOCUMENTS

EP 1 826 442 A1 8/2007
JP 2002-206460 7/2002
JP 3422373 B 4/2003
JP 2007-092745 4/2007

* cited by examiner

*Primary Examiner* — Noah Kamen
*Assistant Examiner* — Grant Moubry
(74) *Attorney, Agent, or Firm* — Carrier Blackman & Associates, P.C.; Joseph P. Carrier; William D. Blackman

(57) ABSTRACT

A V-type internal combustion engine includes a crankcase, a crankshaft disposed in the crankcase, and first and second banks operatively attached to the crankcase. The engine also includes a throttle body, an electric motor and a force-transmitting device arranged between the first and second banks. The force-transmitting device is disposed adjacent the front bank with respect to the throttle body. The force-transmitting device is disposed on a non-transmitting portion side opposite to a side where a timing mechanism is located with respect to a branch pipe of an intake air routing pipe, which supplies intake air into a cylinder adjacent to the timing mechanism of the first bank. An electric motor for operating the throttle valve is provided in the throttle body, and fuel injection valves are arranged between the banks.

20 Claims, 7 Drawing Sheets

V-TYPE INTERNAL COMBUSTION ENGINE INCLUDING THROTTLE VALVE DEVICE, AND VEHICLE INCORPORATING SAME

CROSS-REFERENCE TO RELATED APPLICATIONS

The present invention claims priority under 35 USC 119 based on Japanese patent applications Nos. 2008-164353 and 2008-164593, each filed on Jun. 24, 2008. The entire subject matter of each of these priority documents, including the specification, claims and drawings, is incorporated by reference herein.

BACKGROUND OF THE INVENTION

1. Field of the Invention

The present invention relates to a V-type internal combustion engine, including an intake apparatus disposed between two spaced-apart banks of the engine, and to a vehicle incorporating the described engine. More particularly, the present invention relates to a V-type internal combustion engine including an intake apparatus including a throttle body having a throttle valve therein, which is operated (drivingly opened and closed) by a force-transmitting device arranged in a space formed between the banks, and specifically, arranged adjacent one of the banks. The invention also relates to a vehicle such as a motorcycle including the described engine.

2. Description of the Background Art

There is a known intake apparatus for a V-type internal combustion engine. The intake apparatus includes a throttle valve device having a throttle body provided with a throttle valve, which is drivingly opened and closed by a throttle actuator equipped with an actuator (e.g., an electric motor). An example of such known intake apparatus for a V-type internal combustion engine is disclosed in the Japanese Patent No. 3422373.

There is also a known intake apparatus, in which a throttle body of a throttle valve device is disposed between the banks (a pair of banks) of a V-type internal combustion engine. The Japanese Laid-open Patent Document No. 2002-206460 discloses a V-type internal combustion engine of this type.

In a V-type internal combustion engine, an actuator for operating a throttle valve is disposed below a throttle body, and the throttle body is disposed above a pair of banks. In such a case, the position of the throttle valve device is raised so that the space occupied by the throttle valve device above a pair of banks is increased in a up-down direction. This enlarges the internal combustion engine in the up-down direction.

It is intended, therefore, to dispose the throttle body between the pair of banks in order to reduce size of the V-type internal combustion engine in the up-down direction. The intention needs to prevent the interference between a force-transmitting device for transmitting the drive force of the actuator to the throttle valve and cylinder heads and head covers constituting the banks.

Thus, the arrangement of the force-transmitting device may be restricted in the up-down direction or in a crank axial direction parallel to the rotational centerline of a crankshaft. Specifically, a portion of the cylinder heads and head covers that restricts the arrangement of the force-transmitting device is a protruding portion protruding toward a bank central plane bisecting the bank angle because a valve train force-transmitting device for driving a valve train system is provided on each of the banks.

Such a case does not sufficiently achieve compactification of the arrangement of the throttle valve device for the pair of banks. In other words, the compactification of the internal combustion engine is not sufficiently achieved in the up-down direction or in the crank axial direction.

The present invention has been made in view of such situations. Accordingly, it is one of the objects of the present invention, according to first through fourth aspects thereof, to reduce dimension (downsize) of a V-type internal combustion engine in an up-down direction or in a crank axial direction by devising arrangement of a force-transmitting device for transmitting drive force of an actuator to a throttle valve with respect to a pair of banks.

The present invention is also aimed at facilitating connection work of a fuel injection valve with a fuel supply pipe by preventing interruption of an actuator and a force-transmitting device and making the arrangement of a fuel supply pipe compact. The present invention also aimed at providing cooling arrangement for an electric motor as an actuator with outside air flowing toward an air inlet of an air inlet device.

There is another known a V-type internal combustion engine in which a fuel injection valve is disposed above an intake passage formed in an intake apparatus disposed between a pair of banks of the engine. An example of such known V-type internal combustion engine is disclosed in the Japanese Patent Laid-open No. 2007-92745.

An electric actuator for operating a throttle valve and an electric fuel injection valve are disposed a bank space between a pair of banks of a V-type internal combustion engine. The bank space defined between the pair of banks is a relatively narrow space. It is desirable to easily connect wiring harnesses with the actuator and with the fuel injection valves for transmitting control signal thereto and to shorten the wiring harnesses.

The present invention has also been made in view of such situations. Accordingly, it is one of the objects of the present invention, according to fifth through eighth aspects thereof, to facilitate connection of wiring harnesses with an electric actuator and an electric fuel injection valve disposed between a pair of banks in a V-type internal combustion engine equipped with a throttle valve device provided with a throttle valve drivingly opened and closed by the actuator.

It is also an object of the present invention to facilitate connection work between a fuel injection valve and a fuel supply pipe by preventing interference of an actuator and to make arrangement of the fuel supply pipe compact.

SUMMARY OF THE INVENTION

In order to achieve the above objects, the present invention according to a first aspect thereof provides a V-type internal combustion engine including: a first bank and a second bank arranged in a V-shaped profile defining a bank central plane therebetween, the bank central plane being parallel to a crank axial direction, which is parallel to a rotational centerline of a crankshaft, and the bank central plane bisecting a bank angle; an intake apparatus including a throttle valve device having a throttle body and a throttle actuator for operating (drivingly opening and closing) the throttle valve, and an intake air routing pipe connected to a cylinder head of the first bank and to a cylinder head of the second bank and adapted to lead (supply) intake air flow controlled by the throttle valve into a first cylinder of the first bank and into a second cylinder of the second bank; a first valve train system and a second valve train system in the first bank and the second bank provided on the respective cylinder heads thereof for operating an intake valve and an exhaust valve; and a first valve train timing mechanism and a second valve train timing mechanism provided on the first bank and the second bank, respectively, for operating drive the first valve train system and the second valve train system, respectively.

In the V-type internal combustion engine, the throttle actuator includes an actuator, and a force-transmitting device for transmitting drive force produced by the actuator to the throttle valve. The throttle body, the actuator and the force-transmitting device are disposed between the first bank and the second bank.

The force-transmitting device is disposed at a position on a side of the first bank with respect to the throttle body and opposite the first bank in a perpendicular direction perpendicular to the bank central direction, and on a side opposite to a side where the first valve train timing mechanism is located with respect to the intake air routing pipe adapted to supply (lead) intake air into the first cylinder adjacent to the first valve train timing mechanism in the crank axial direction.

The present invention according to a second aspect thereof, in addition to the first aspect, is characterized in that the throttle body is disposed at a position so as to be offset toward the second bank with respect to the bank central plane in the perpendicular direction.

The present invention according to a third aspect thereof, in addition to one of the first and second aspects, is characterized in that a first fuel injection valve for injecting fuel to intake air directed to the first cylinder and a second fuel injection valve for injection fuel to intake air directed to the second cylinder are arranged on one direction side of the crank axial direction with respect to the actuator and in the same direction as the actuator with respect to the throttle body, and a fuel supply pipe connected to the first fuel injection valve and to the second fuel injection valve is arranged to come close to the second bank in the perpendicular direction as the fuel supply pipe extends from the first and second fuel injection valves toward the other direction of the crank axial direction.

The present invention according to a fourth aspect thereof, in addition to one of the first through third aspects, is characterized in that the intake apparatus includes an air inlet device provided with an air inlet adapted to receive in intake air; the actuator is an electric motor; the air inlet opens into a space surrounded by the first bank, the second bank, the throttle body and the air inlet device; and the electric motor is disposed in the space, and exposed to outside air flowing in the space toward the air inlet.

According to the first aspect of the present invention, the force-transmitting device for transmitting the drive force of the actuator to the throttle valve is disposed at a position on the side of the first bank with respect to the throttle body in the perpendicular direction and opposite the first bank in the perpendicular direction, and on the side opposite to the side where the first valve train timing mechanism is located with respect to the intake air routing pipe connected to the cylinder head of the first bank in the crank axial direction.

Therefore, even in the case where a protruding portion protruding toward the bank central plane is formed on the first bank because of the provision of the first drive train timing mechanism, the arrangement of the transmission device is not restricted by the protruding portion so that the flexibility of arrangement of the transmission device is increased in the bank space defined between the pair of banks.

As a result, the throttle valve device in which the throttle body and the force-transmitting device are arranged in the bank space can compactly be arranged in the up-down direction or in the crank axial direction. Furthermore, a dimension of the internal combustion engine can be reduced (downsized) in the up-down direction or in the crank axial direction.

According the second aspect of the present invention, the throttle body is offset from the first bank faced by the force-transmitting device, toward the second bank opposite to the bank central plane in the perpendicular direction. Therefore, the perpendicular-directional distance between the first bank and the force-transmitting device can be increased according to the offset amount. As a result, the flexibility of arrangement of the force-transmitting device in the bank space can further be increased to further enhance the effect of the invention recited in claim 1.

According to the third aspect of the present invention, the fuel supply pipe extends in the direction coming close to the second bank, i.e., the opposite direction of the force-transmitting device, from the first and second fuel injection valves in the perpendicular direction. Therefore, it is possible to prevent the actuator and the force-transmitting device disposed between the first and second banks from interrupting the connection of the fuel supply pipe with the first and second fuel injection valves, which facilitates connection work.

Additionally, the fuel supply pipe connected to the first and second fuel injection valves extends from the first and second fuel injection valves toward the actuator in the crank axial direction. Therefore, the fuel supply pipe is inhibited and prevented from projecting from the first and second fuel injection valves or the intake air routing pipe to the opposite side where the actuator is located in the crank axial direction. This can compactly arrange the fuel supply pipe in the crank axial direction.

According to the fourth aspect of the present invention, the air inlet opens into the space surrounded by the first bank, the second bank, the throttle body and the air inlet device and the electric motor is disposed in the space and exposed to outside air flowing in the space toward the air inlet. Therefore, the electric motor is cooled by outside air flowing in the space toward the air inlet. As a result, the overheating of the electric motor is prevented to sufficiently offer its performance.

The present invention according to a fifth aspect thereof provides a V-type internal combustion engine including: a first bank and a second bank arranged in a V-shape to put a bank central plane therebetween, the bank central plane being a plane parallel to a crank axial direction, which is parallel to a rotational centerline of a crankshaft and bisecting a bank angle; an intake apparatus including a throttle valve device equipped with a throttle body provided with a throttle valve, which is operated by an electric actuator; and an intake air routing pipe connected to a cylinder head of the first bank and to a cylinder head of the second bank and adapted to supply (lead) intake air flow controlled by the throttle valve into a first cylinder of the first bank and into a second cylinder of the second bank; and electric fuel injection valves for injecting fuel to intake air; wherein the actuator and the fuel injection valves are disposed between the first bank and the second bank, and a connector of the actuator and connectors of the fuel injection valves connected to respective wiring harnesses used to transmit control signals to the actuator and the fuel injection valves are disposed above an intake passage formed from the intake apparatus.

The present invention according to a sixth aspect thereof, in addition to the fifth aspect, further includes a first valve train system and a second valve train system in the first bank and the second bank provided on the respective cylinder heads thereof to each operate an intake valve and an exhaust valve; and a first valve train timing mechanism and a second valve train timing mechanism provided on the first bank and the second bank respectively, to drive the first valve train system and the second valve train system, respectively.

The throttle valve device includes a throttle body, the actuator, and a force-transmitting device for transmitting drive force produced by the actuator to the throttle valve, the throttle body and the force-transmitting device are disposed between the first bank and the second bank.

The force-transmitting device is disposed at a position on a side of the first bank with respect to the throttle body and opposite the first bank in a perpendicular direction perpendicular to the bank central direction, and on a side opposite to a side where the first valve train timing mechanism is located with respect to the intake air routing pipe adapted to supply intake air into the first cylinder adjacent to the first valve train timing mechanism in the crank axial direction.

The present invention according to seventh aspect thereof, in addition to the sixth aspect, is characterized in that the throttle body is disposed to be offset toward the second bank with respect to the bank central plane in the perpendicular direction.

The present invention according to an eighth aspect thereof, in addition to one of the sixth and seventh aspects, is characterized in that the fuel injection valves includes a first fuel injection valve for injecting fuel to intake air directed to the first cylinder and a second fuel injection valve for injection fuel to intake air directed to the second cylinder, the first and second fuel injection valves are arranged on one direction side of the crank axial direction with respect to the actuator and in the same direction as the actuator with respect to the throttle body, and a fuel supply pipe connected to the first fuel injection valve and to the second fuel injection valve is arranged so as to come close to the second bank in the perpendicular direction as the fuel supply pipe extends from the first and second fuel injection valves toward the other direction of the crank axial direction.

According to the fifth aspect of the present invention, the respective connectors of the actuator and the fuel injection valves disposed between the first and second banks are disposed above the intake passage. Therefore, the connection of the wiring harnesses adapted to transmit control signals to the actuator and the fuel injection valves can be facilitated and the wiring harnesses can be reduced in length.

According to the sixth aspect of the present invention, the force-transmitting device for transmitting the drive force of the actuator to the throttle valve is disposed at a position on the side of the first bank with respect to the throttle body in the perpendicular direction and opposite the first bank in the perpendicular direction, and on the side opposite to the side where the first valve train timing mechanism is located with respect to the intake air routing pipe connected to the cylinder head of the first bank in the crank axial direction.

Therefore, even in the case where the protruding portion protruding toward the bank central plane is formed on the first bank because of the provision of the first drive train timing mechanism, the arrangement of the transmission device is not restricted by the protruding portion so that the flexibility of arrangement of the transmission device is increased in the bank space defined between the pair of banks.

As a result, the throttle valve device in which the throttle body and the force-transmitting device are arranged in the bank space can compactly be arranged in the up-down direction or in the crank axial direction. Furthermore, the internal combustion engine can be downsized in the up-down direction or in the crank axial direction.

According to the seventh aspect of the present invention, the throttle body is offset from the first bank faced by the force-transmitting device, toward the second bank opposite to the bank central plane in the perpendicular direction. Therefore, the perpendicular-directional distance between the first bank and the force-transmitting device can be increased according to the offset amount. As a result, the flexibility of arrangement of the force-transmitting device in the bank space can further be increased.

According to the eighth aspect of the present invention, the fuel supply pipe extends in the direction coming close to the second bank from the first and second fuel injection valves in the perpendicular direction. Therefore, it is possible to prevent the actuator disposed between the first and second banks from interrupting the connection of the fuel supply pipe with the first and second fuel injection valves, which facilitates connection work.

Additionally, the fuel supply pipe connected to the first and second fuel injection valves extends from the first and second fuel injection valves toward the actuator in the crank axial direction. Therefore, the fuel supply pipe is inhibited and prevented from projecting from the first and second fuel injection valves or the intake air routing pipe to the opposite side where the actuator is located in the crank axial direction. This can compactly arrange the fuel supply pipe in the crank axial direction.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

An embodiment of the present invention will now be described, with reference to the drawings. Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

Illustrative embodiments of the present invention are hereinafter described with reference to FIGS. 1 through 7.

Figure 1:
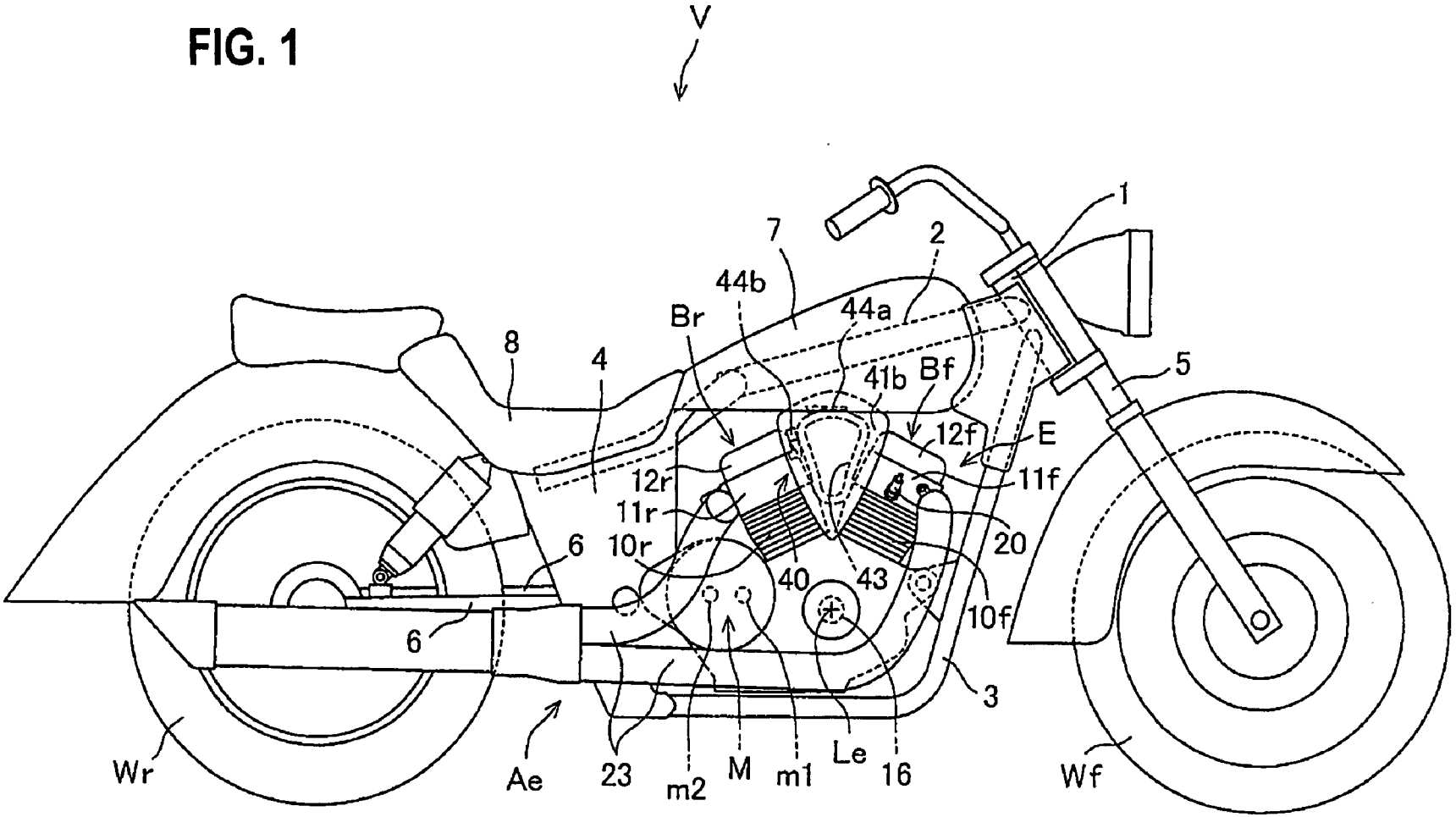
FIG. 1 is a right lateral view illustrating an essential portion of a motorcycle having mounted thereon a V-type internal combustion engine according to the present invention.

As shown in FIG. 1, a V-type internal combustion engine E is an internal combustion engine, which, along with a transmission M, provides a powertrain unit for a motorcycle V as a vehicle. The transmission M receives power from a crankshaft 16 of the internal combustion engine E. In addition, the transmission M is a gear-type transmission including a main shaft m1, a countershaft m2 and speed change gears.

The motorcycle V includes a body frame including a head pipe 1, a main frame 2, a down tube 3 and a pivot plate 4; the powertrain unit supported by the body frame; a front wheel Wf rotatably supported by a front fork 5 steerably supported by the head pipe 1; a rear wheel Wr rotatably supported by a pair of swing arms 6 swingably supported by the pivot plate 4; and a fuel tank 7 and an occupant seat 8 supported by the body frame.

The power produced by the internal combustion engine E is directed from the crankshaft 16 to the transmission M for speed-change, and then transmitted from an output shaft of the transmission M via a final reduction mechanism to the rear wheel Wr. The final reduction mechanism is provided with a drive shaft housed in a left swing arm 6.

Figure 2:
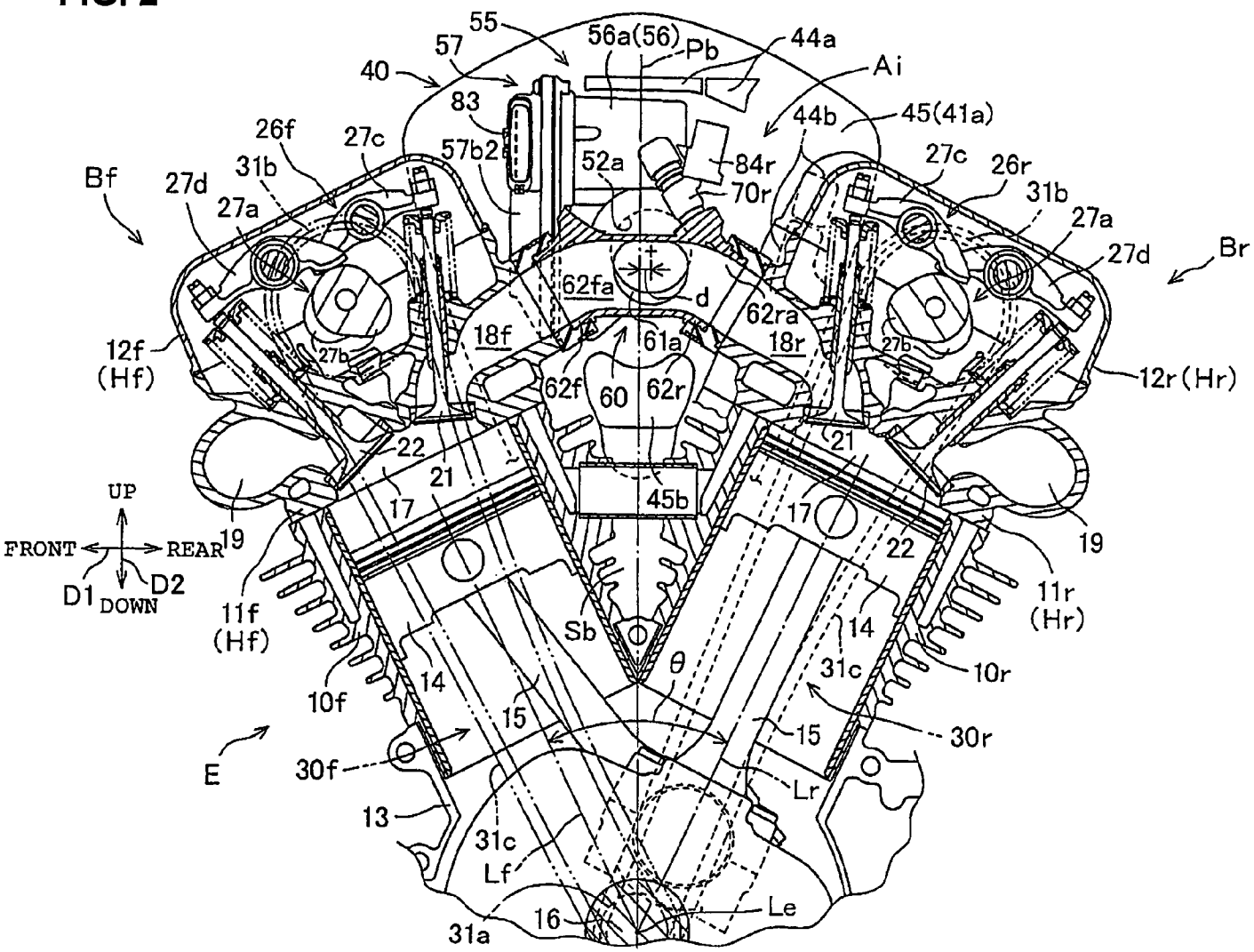
FIG. 2 is a left side cross-sectional view of the engine of FIG. 1 taken along a plane substantially perpendicular to a crank axial direction.
Figure 3:
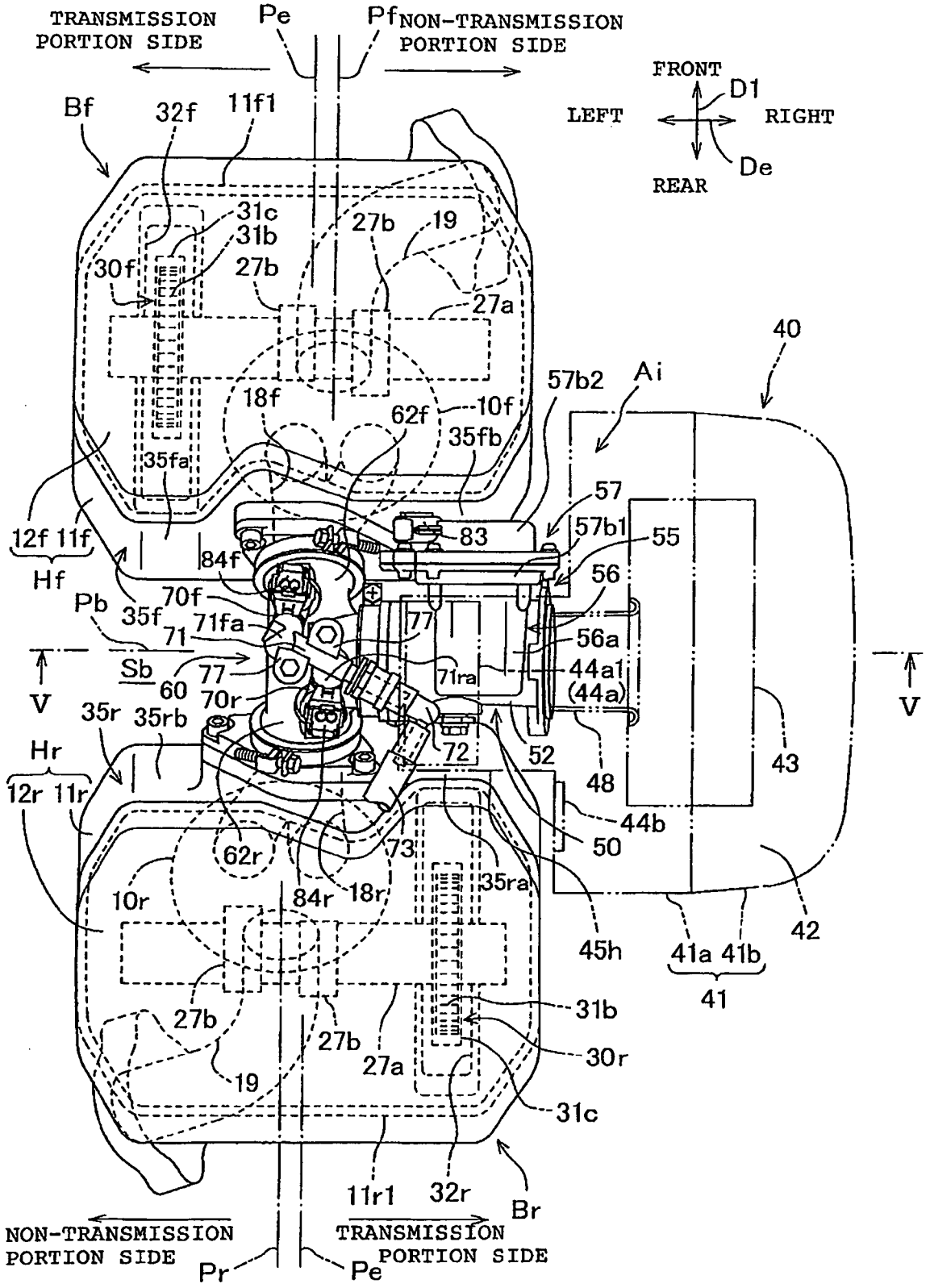
FIG. 3 is a plan view mainly illustrating cylinder heads, head covers and an intake apparatus in the engine of FIG. 1.

With additional reference to FIGS. 2 and 3, the internal combustion engine E is supported by the body frame in a transverse-mounted arrangement, where a rotational centerline Le of the crankshaft 16 is oriented in the vehicle-width direction of the motorcycle V. The internal combustion engine E is provided with an engine body including a hollow crankcase 13 having the crankshaft 16 rotatably mounted therein, and a pair of banks Bf, Br operatively attached to the crankcase and extending upwardly thereon in a V-shaped configuration, as shown.

The banks Bf and Br include a pair of cylinders 10*f* and 10*r*, respectively, arranged in a V-shaped profile as viewed from a crank axial direction De (also referred as "as viewed from the side"). The crankcase 13 is connected to the lower ends of the cylinders 10*f*, 10*r*.

The front bank Bf as a first bank includes the cylinder 10*f* as a first cylinder; a first cylinder head 11*f* connected to the upper end of the cylinder 10*f*; and a first head cover 12*f* connected to a connection surface 11*f*1 of the upper end of the cylinder head 11*f*.

The rear bank Br as a second bank includes the cylinder 10*r* as a second cylinder; a second cylinder head 11*r* connected to the upper end of the cylinder 10*r*; and a second head cover 12*r* connected to a connection surface 11*r*1 of the upper end of the cylinder head 11*r*.

The cylinder head 11*f* and the head cover 12*f* constitute an engine head portion Hf in the first bank Bf. The cylinder head 11*r* and the head cover 12*r* constitute an engine head portion Hr in the second bank Br. The banks Bf and Br have similar basic structure.

The first cylinder constituting the front bank Bf is composed of either a single cylinder or a plurality of cylinders. In the present embodiment, the front bank Bf is composed of only the single cylinder 10*f*. Similarly, the second cylinder constituting the rear bank Br is composed of either a single cylinder or a plurality of cylinders. In the present embodiment, the rear bank Br is composed of the single cylinder 10*r*.

The crankcase 13 formed by joining together left-right split case half bodies, which rotatably journal the crankshaft 16 therebetween.

As shown in FIG. 2, a bank angle θ is formed between a cylinder axis Lf of the front bank Bf and a cylinder axis Lr of the rear bank Br when viewed in a side view. The bank angle θ is an acute angle. The front bank Bf and the rear bank Br are arranged in a V-shaped profile with a bank central plane Pb formed therebetween and extending vertically in a direction D1 which is perpendicular to the plane of the drawing. A bank space Sb is defined between both the banks Bf, Br, i.e., in a range formed between both the banks Bf, Br in the perpendicular direction D1 and in a range where both the banks Bf, Br are located in an up-down direction D2.

The crank axial direction De is a direction parallel to, and substantially coincident with the rotational centerline Le of the crankshaft 16. The bank central plane Pb, as a reference plane of the internal combustion engine E, is parallel to the crank axial direction De. In addition, the bank central plane Pb is a plane that bisects the bank angle θ, or in other words, the bank central plane Pb makes an angle formed between the cylinder axis Lf and the bank central plane Pb equal to an angle formed between the cylinder axis Lr and the bank central plane Pb.

A direction perpendicular to the bank central plane Pb is defined as the perpendicular direction D1. A direction perpendicular to the crank axial direction De on the bank central plane Pb is defined as the up-down direction D2. In the up-down direction D2, a upper or top side is defined as a side where the cylinder heads 11*f*, 11*r* or a throttle valve 51 (see FIG. 5) is located, with respect to the rotational centerline Le.

In the illustrative embodiment, the crank axial direction De coincides with the left-right direction of the motorcycle V. The bank central plane Pb is a vertical plane. The perpendicular direction D1 is a back and forth (front to rear) direction of the motorcycle V. The up-down direction D2 is an up-down direction of the motorcycle V. If one of the right or left is defined as one direction of the crank axial direction De, the other of the right or left is defined as the other direction of the crank axial direction De. If one of the front and rear is defined as one direction of the perpendicular direction D1, the other of the front and rear is defined as the other direction of the perpendicular direction D1.

With reference to FIGS. 2 and 3, a piston 14, connected to the crankshaft 16 via a connecting rod 15, is slidably fitted into each of the respective cylinders 10*f*, 10*r* in a reciprocally movable manner. Each of the cylinder heads 11*f*, 11*r* includes a combustion chamber 17 opposed to the piston 14 in the cylinder axial direction; a corresponding one of intake ports 18*f*, 18*r* adapted to lead intake air from an intake apparatus Ai (described later) into the combustion chamber 17; an exhaust port 19 adapted to lead exhaust gas from the combustion chamber 17 to an exhaust system Ae (see FIG. 1) (described later); an ignition plug 20 (see FIG. 1) facing the combustion chamber 17; and an intake valve 21 and an exhaust valve 22 for opening and closing each of the intake ports 18*f*, 18*r* and an exhaust port 19, respectively.

The internal combustion engine E includes the intake apparatus Ai formed with an air intake passage adapted to lead intake air into each combustion chamber 17 and into the cylinders 10*f*, 10*r*; fuel injection valves 70*f*, 70*r* (see FIG. 4) as mixture-forming units for supplying fuel to the intake air to form an air/fuel mixture; and the exhaust system Ae (see FIG. 1) formed with an exhaust passage adapted to lead combustion gas as exhaust gas from the combustion chamber 17 to the outside of the internal combustion engine E. The combustion gas is produced through combustion of fuel ignited by the ignition plug 20 in the combustion chamber 17.

The internal combustion engine E further includes first and second valve train systems 26*f* and 26*r* for operating the intake valve 21 and the exhaust valve 22 in each of the respective banks Bf and Br. The internal combustion engine E further includes first and second valve train timing mechanisms 30*f* and 30*r* for driving the first and second valve train systems 26*f* and 26*r*, respectively; and a control device 80 (see FIG. 5) for controlling operation of the fuel injection valves 70*f*, 70*r*, the ignition plugs 20, etc.

In an intake stroke, when the intake valve 21 is opened and the piston 14 is moved downwardly, the intake air that has passed through the intake apparatus Ai is drawn into the combustion chambers 17 and cylinders 10*f* and 10*r* through the intake ports 18*f* and 18*r*, respectively. In a compression stroke, in which the piston 14 is moved upwardly with both valves 21, 22 closed, the mixture resulting from mixing of the intake air with fuel is compressed. At the end of the compression stroke, the mixture is ignited by the ignition plug 20 for combustion.

In an expansion stroke, in which the piston 14 is moved downwardly, the valves 21, 22 remain closed, and the piston 14 is driven by the pressure of the combustion gas to rotatably drive the crankshaft 16 via the connecting rod 15. In the exhaust stroke, in which the piston 14 is once again moved upwardly, the exhaust valve 22 is opened, and the burned combustion gas is discharged as exhaust gas from the combustion chamber 17 to the exhaust port 19. Further, the exhaust gas is discharged to the outside of the internal combustion engine E through the exhaust system Ae provided with an exhaust pipe 23 (see FIG. 1) connected to the exhaust side walls of the cylinder heads 11*f*, 11*r*.

In both the banks Bf and Br, the first and second valve train systems 26*f* and 26*r* provided on the cylinder heads 11*f* and 11*r*, respectively, each include a camshaft 27*a* having a valve-operating cam 27*b*; and an intake rocker arm 27*c* and an exhaust rocker arm 27*d* abutted, respectively, against the intake valve 21 and the exhaust valve 22 and driven by the valve-operating cam 27*b*.

The first and second valve train timing mechanisms 30*f* and 30*r* provided on the front and rear banks Bf and Br, respectively, each include a drive sprocket 31*a* as a drive rotating body provided on the crankshaft 16; a cam sprocket 31*b* as a driven rotating body provided on the camshaft 27*a*; and a chain 31*c* as an endless transmission belt wound around both the sprockets 31*a*, 31*b*.

The drive sprocket 31*a* of the first timing mechanism 30*f* is provided at an axial end portion of the crankshaft 16 extending leftward from a crank chamber formed as part of the crankcase 13. The drive sprocket 31*a* of the second timing mechanism 30*r* is provided at an axial end portion of the crankshaft 16 extending rightward from the crank chamber.

The chain 31*c* as part of the timing mechanism 30*f* is housed in the chain chamber 32*f* as a housing chamber formed as a cavity provided to extend from the cylinder head 11*f* via the cylinder 10*f* to the crankcase 13. Similarly, the chain 31*c* as part of the timing mechanism 30*r* is housed in the chain chamber 32*r* as a housing chamber formed as a cavity provided to extend from the cylinder head 11*r* via the cylinder 10*r* to the crankcase 13.

In each of the banks Bf, Br, the valve-operating cam 27*b* of the camshaft 27*a* rotatably driven by each of the timing mechanisms 30*f*, 30*r* operates (drivingly opens and closes) the intake valve 21 and the exhaust valve 22 at predetermined timing in response to the turning position of the crankshaft 16 via the intake rocker arm 27*c* and the exhaust rocker arm 27*d*.

In the engine head portion Hf of the first bank Bf, namely, in the cylinder head 11*f* and the head cover 12*f*, since the timing mechanism 30*f* is disposed and the chain chamber 32*f* is formed, the air intake side wall 35*f* facing the bank central plane Pb in the perpendicular direction D1 includes an adjacent portion 35*fa* as a projecting portion projecting toward the bank central plane Pb and a distant portion 35*fb*.

The distant portion 35*fb* is located at a distance, from the bank central plane Pb in the perpendicular direction D1, which is greater than that of the adjacent portion 35*fa*. Similarly, in the engine head portion Hr of the bank Br, namely, in the cylinder head 11*r* and the head cover 12*r*, since the timing mechanism 30*r* is disposed and the chain chamber 32*r* is formed, the air intake side wall 35*r* facing the bank central plane Pb in the perpendicular direction D1 includes an adjacent portion 35*ra* as a projecting portion projecting toward the bank central plane Pb and a distant portion 35*rb*.

The distant portion 35*rb* is located at distance, from the bank central plane Pb in the perpendicular direction D1, which is greater than that of the adjacent portion 35*ra*. Incidentally, when the engine body including the cylinder heads 11*f*, 11*r* is provided with cooling fins, the adjacent portions 35*fa*, 35*ra* and the distant portions 35*fb*, 35*rb* do not include such fins.

In the front bank Bf, the adjacent portion 35*fa* is located on a transmission portion side where the timing mechanism 30*f* is located with respect to the first cylinder central plane Pf or the engine central surface Pe in the crank axial direction De. In addition, the distant portion 35*fb* is located, in the crank axial direction De, on a non-transmission portion side opposite to the transmission portion side with respect to the first cylinder central plane Pf or to the engine central surface Pe and closer to the first cylinder central plane Pf or to the engine central surface Pe than the adjacent portion 35*fa* on the transmission portion side.

Similarly, in the rear bank Br, the adjacent portion 35*ra* is located on a transmission portion side where the timing mechanism 30*r* is located with respect to the second cylinder central plane Pr or the engine central surface Pe in the crank axial direction De.

In addition, the distant portion 35*rb* is located, in the crank axial direction De, on a non-transmission portion side opposite to the transmission portion side with respect to the second cylinder central plane Pr or to the engine central surface Pe, and closer to the second cylinder central plane Pr or to the engine central surface Pe than the adjacent portion 35*ra* on the transmission portion side. Thus, the distant portions 35*fb*, 35*rb* are each located to extend from the non-transmission portion side to the transmission portion side.

The cylinder central plane is a plane being perpendicular to the crank axial direction De and including the cylinder axes Lf, Lr. In the front bank Bf, a plane including the cylinder axis Lf of the cylinder 10*f* as the first cylinder adjacent to the timing mechanism 30*f* in the crank axial direction De is the cylinder central plane Pf.

In the rear bank Br, a plane including the cylinder axis Lr of the cylinder 10*r* as the second cylinder adjacent to the timing mechanism 30*r* in the crank axial direction De is the second cylinder central plane Pr.

The engine central surface Pe is a plane located at the center between the first cylinder central plane Pf and the second cylinder central plane Pr in the crank axial direction De, that is, the engine central surface Pe is situated equidistant from both the cylinder central planes Pf, Pr, and being parallel to the cylinder central planes Pf, Pr.

The front bank Bf and rear bank Br are arranged such that one (e.g., the front bank Bf) of the banks projects in the direction where the timing mechanism 30*f* of the one bank (e.g., the front bank Bf) is located (in the embodiment, the front bank Bf is leftward of the rear bank Br), with respect to the other bank (e.g., the rear bank Br).

With reference to FIGS. 2 through 7, the intake apparatus Ai includes an air cleaner 40 (see also FIG. 1), a throttle body 50, an air inlet tube 48, and an intake air duct 60.

The air cleaner 40 serves as an air intake apparatus, which takes in air from outside of the vehicle as intake air. The throttle body 50 is provided with a cylindrical throttle bore 52 equipped with a throttle valve 51 for controlling a flow rate of the intake air from the air cleaner 40. The air inlet tube 48 connects the air cleaner 40 with the throttle body 50, to form an air passage 48*a* adapted to lead intake air from the air cleaner 40 to the throttle body 50.

The intake air duct 60 is adapted to lead the intake air whose flow rate is controlled by the throttle valve 51, to the combustion chambers 17 and the cylinders 10*f*, 10*r*. The throttle body 50 and the intake air duct 60 are disposed in the bank space Sb between the banks Bf, Br.

The air cleaner 40 is disposed rightward of the throttle body 50 and of the intake air duct 60 in the crank axial direction De. In addition, the air cleaner 40 includes a case 41 provided with an air inlet 44 adapted to take in intake air and forming an air chamber 42; and a cleaner element 43 disposed in the air chamber 42 to partition it into an unfiltered air chamber 42*a* and a filtered air chamber 42*b*. The case 41 includes a first case section 41*a* joined to the right end portion of the throttle bore 52 along with the air inlet tube 48 and a second case section 41*b* joined to the right end portion of the first case section 41*a* to form the air chamber 42 in cooperation with the first case section 41*a*.

The intake air flowing in the unfiltered air chamber 42*a* from the air inlet 44 passes through the cleaner element 43 for purification, and then flows in the filtered air chamber 42*b*. The purified air further passes through the air passage 48*a* and flows in the throttle passage 52*a* of the throttle body 50.

A case wall 45 of the first case section 41*a* is provided with the air inlet 44, with a base 45*a* to which the throttle bore 52 is connected, and with a side-branch 45*b* forming a silencer chamber adapted to reduce intake noise. The base 45*a* is formed on the periphery of the throttle bore 52 so as to be radially, generally like a flat plate around a passage centerline Lt of the throttle passage 52*a*. The side-branch 45*b*, formed like a bottomed pipe, is disposed below the throttle bore 52 and in the bank space Sb so as to project toward the left in the crank axial direction De, or toward the engine central surface Pe in the case wall 45.

Further, the case wall 45 is provided with a plurality of attachment portions 45*c*, with a plurality of attachment seats 45*d*, and with a drainage opening 45*e*. The attachment portions 45*c* are each provided with a hole adapted to receive a bolt inserted therethrough which is used to join the air cleaner 40 to the engine body. The attachment seats 45*d* are each adapted to receive a bolt 45*d*1 (see FIG. 5) screwed thereinto which is used to join the second case section 41*b* thereto. The drainage opening 45*e* is adapted to discharge water entering the air chamber 42.

The throttle body 50 includes the throttle valve 51, which is a pivotally movable butterfly valve; the throttle bore 52 forming the throttle passage 52*a* in which the throttle valve 51 is disposed; and a throttle actuator 55 for operating the throttle valve 51. The throttle bore 52 and the throttle actuator 55 are generally disposed between both the banks Bf, Br.

The throttle valve 51 includes a valve shaft 51*a* pivotally supported in the throttle bore 52. The valve shaft 51*a* is disposed generally parallel to the perpendicular direction D1. The throttle valve 51 has a turning centerline Lv (see FIG. 6) generally parallel to the perpendicular direction D1.

Figure 4:
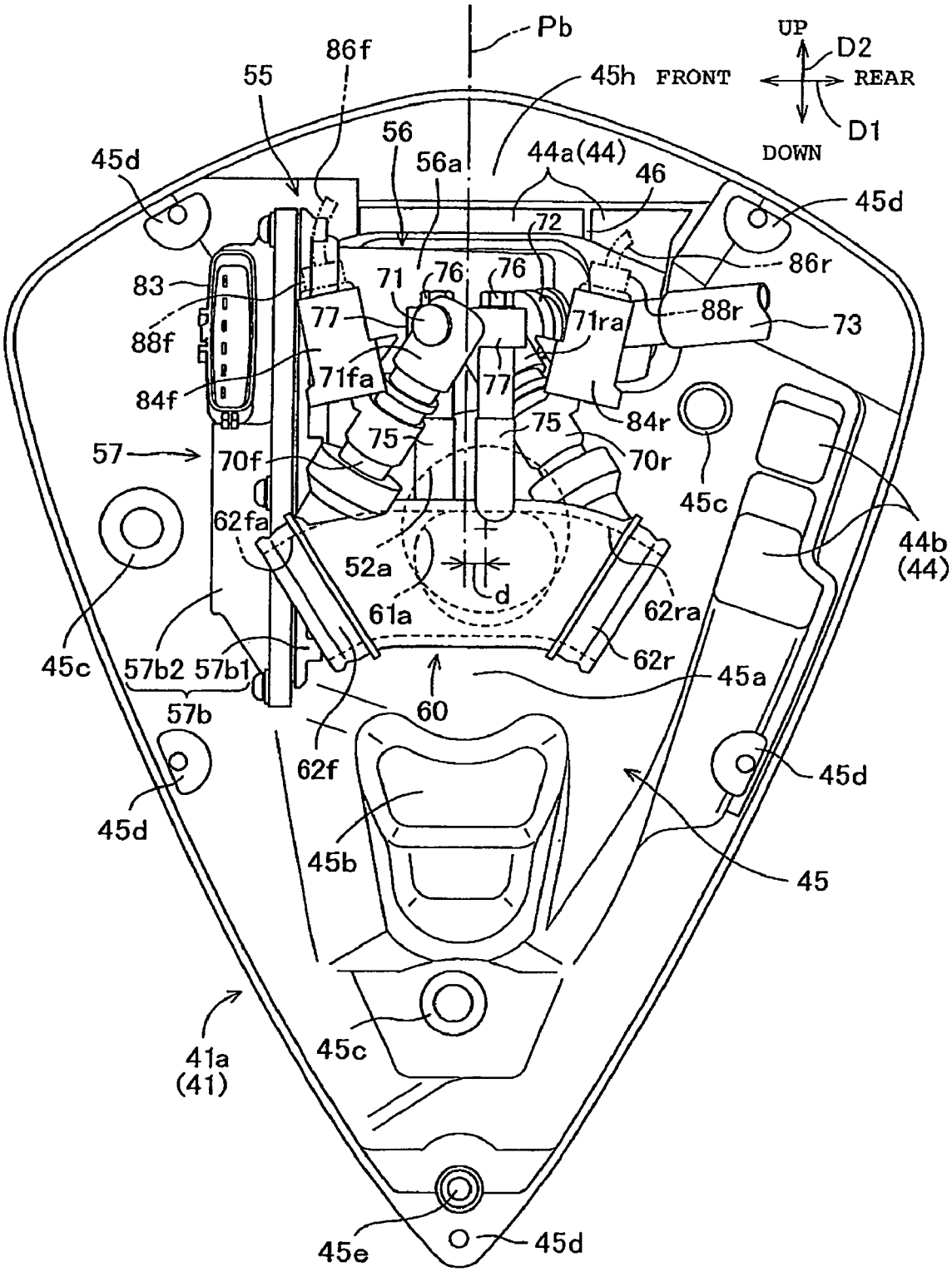
FIG. 4 is a left lateral view mainly illustrating the intake apparatus of the engine of FIG. 1.

The throttle passage 52*a* and an assembly passage 61*a* (described later) have the linear passage centerline Lt and a liner passage centerline Lc, respectively, generally parallel to the crank axial direction De. The passage centerlines Lt, Lc are offset by a predetermined distance d with respect to the bank central plane Pb toward the rear bank Br in the perpendicular direction D1 (see FIGS. 2 and 4). Thus, the throttle bore 52 and the assembly pipe 61 (described later) are offset with respect to the bank central plane Pb toward the rear bank Br. In FIGS. 2 and 4, the position of the passage centerline Lt at an upstream end opening 52*a*1 (see FIG. 5) of the throttle passage 52*a* is indicated by a symbol "+".

If it is assumed that a direction parallel to the passage centerline Lt is a passage centerline direction Dt, the passage centerline direction Dt is generally parallel to the crank axial direction De and to the passage centerline Lc. Thus, the crank axial direction De is substantially the same as the passage centerline direction Dt.

Incidentally, in this specification, the expression "generally" includes expressions without "generally" as a modifying word and means a range without a significant difference with respect to a function and an effect compared with the expressions without "generally" as a modifying word, although the expression "generally" may disagree with the expression without "generally" as the modifying word.

The throttle actuator 55 includes an electric motor 56 as a mechanism for producing drive force adapted to turn and operate the throttle valve 51; and a force-transmitting device 57 for transmitting the drive force of the electric motor 56 to the throttle valve 51.

The electric motor 56 or an electric actuator includes a housing 56*a* disposed at the same position as the throttle bore 52 in the passage centerline direction Dt and on the periphery of the throttle bore 52; and a rotating shaft 56*b* as a driving member extending to pass through the housing 56*a* and applying the driving force to the force-transmitting device 57.

The force-transmitting device 57 includes a gear train 57*a* as a transmitting member for transmitting the drive force applied from the rotating shaft 56*b* to the throttle vale 51; and a housing case 57*b* for housing the gear train 57*a*, and is fixedly attached to the throttle bore 52.

A rotational centerline Lm of the rotating shaft 56*b* is generally parallel to the valve shaft 51*a* of the throttle valve 51 or to the rotational centerline Lv. A rotational centerline direction Dm parallel to the rotational centerline Lm is generally perpendicular to the crank axial direction De. Thus, the rotational centerline Lm is generally perpendicular to the rotational centerline Le of the crankshaft 16 as viewed from the up-down direction D2 (also referred to as "as viewed from above").

The gear train 57*a* is a reduction mechanism configured to include a drive gear 57*a*1 as an input portion formed integrally with the rotational shaft 56*b* in the housing case 57*b*; an intermediate gear 57*a*3; and an output portion composed of an output gear 57*a*2 which is a segment gear integrally joined to the valve shaft 51*a* of the throttle valve 51.

The housing case 57*b* includes a case body 57*b*1 detachably mounted to an attachment seat 52*b* (see FIG. 6) formed integrally with the front portion of the throttle bore 52; and a cover 57*b*2 joined to the case body 57*b*1. The cover 57*b*2 is molded integrally with and provided with a connector 83 to which an electric wire side (a harness side) connector 87 of an electric wiring harness 85 is connected.

The wiring harness 85 is adapted to transmit a control signal controlled by the control device 80 (see FIG. 5) in order to control the operation of the electric motor 56. The electric motor 56 drivingly opens and closes the throttle valve 51 in accordance with an accelerator operation amount by an operator and with an engine operational state of the internal combustion engine E (also referred to as "the engine operation state").

The connector 83 also serves as a connector housed in the housing case 57*b* to connect with an electric wire (wiring harness) used to take out a detection signal of opening angle detection means 82*d* (conceptually illustrated in FIG. 5) for detecting the opening angle of the throttle valve 51.

The connector 83 is disposed above the throttle bore 52, at the same position as the housing 56*a* in the up-down direction D2, and close to the intake air duct 60 and to the fuel injection valves 70*f*, 70*r* in the crank axial direction De in the cover 57*b*2.

With reference to FIGS. 2 through 5, and 7, the intake air duct 60 includes an assembly pipe 61 joined to the throttle bore 52 at an upstream end portion; and a first branch pipe 62*f* and a second branch pipe 62*r*. The first and second branch pipes 62*f* and 62*r* diverge from the assembly pipe 61 on the intake air downstream side, and are joined to the walls 35*f* and 35*r* of the cylinder heads 11*f* and 11*r* of the front bank Bf and the rear bank Br, respectively.

The assembly passage 61*a* formed by the assembly pipe 61 branches into first and second branch passages 62*fa* and 62*ra* formed respectively by the branch pipes 62*f* and 62*r*. The branch passages 62*fa* and 62*ra* communicate with the intake ports 18*f* and 18*r* of the banks Bf and Br, respectively.

The air passage 48*a* and the throttle passage 52*a* constitute an upstream side intake passage. The assembly passage 61*a* and the branch passages 62*fa*, 62*ra* constitute a downstream side intake passage formed by the intake air duct 60. The air chamber 42, the upstream side intake passage and the downstream side intake passage constitute an intake passage formed by the intake apparatus Ai. The air passage 48*a*, the throttle passage 52*a* and the assembly passage 61*a* are a common intake passage shared by both the banks Bf, Br in order to lead intake air to all the cylinders 10*f*, 10*r*.

The fuel injection valves 70*f* and 70*r* provided respectively for the cylinders 10*f* and 10*r* are respectively composed of a first fuel injection valve 70*f* for injecting fuel into intake air directed to the cylinder 10*f* of the front bank Bf and a second fuel injection valve 70*r* for injecting fuel into intake air directed to the cylinder 10*r* of the rear bank Br.

The first and second fuel injection valves 70*f* and 70*r* are disposed between both the banks Bf, Br and respectively mounted to the upper portions of the first and second branch pipes 62*f* and 62*r*. In this way, the first and second fuel injection valves 70*f* and 70*r* are respectively oriented to the intake ports 18*f* and 18*r* of both the banks Bf and Br and inject fuel to the branch passages 62*fa* and 62*ra*. A single fuel supply pipe 71 adapted to receive fuel supplied under pressure from the fuel pump is connected to both the fuel injection valves 70*f*, 70*r*.

The first and second fuel injection valves 70*f*, 70*r* are disposed on the left side of, i.e., on one side of the electric motor 56 and the force-transmitting device 57 in the crank axial direction De. The fuel injection valves 70*f*, 70*r* and the fuel supply pipe 71 are disposed above the branch passages 62*fa*, 62*ra*.

The electric type fuel injection valves 70*f* and 70*r* are respectively provided with connectors 84*f* and 84*r* connected respectively to electric wire side connectors 88*f* and 88*r* of wiring harnesses 86*f* and 86*r*. The wiring harnesses 86*f* and 86*r* are adapted to transmit control signals controlled by the control device 80 in order to control the fuel injection timing and fuel supply amount of the fuel injection valves 70*f* and 70*r*, respectively. The connectors 84*f*, 84*r* are disposed above the throttle bore 52 and the intake air duct 60, thus, above the throttle passage 52*a*, the assembly passage 61*a* and the branch passages 62*fa*, 62*ra*, and at the same position as the connector 83 in the up-down direction D2.

The fuel supply pipe 71 is inclined relative to the crank axial direction De as viewed from above and extends linearly. The fuel supply pipe 71 includes connection portions 71*fa* and 71*ra* connected respectively to upper end portions of the fuel injection valves 70*f* and 70*r*; and a pair of attachment portions 77 attached to attachments bosses 75 of both the branch pipes 62*f*, 62*r* with bolts 76. The fuel supply pipe 71 is provided with a fuel introduction port at an upstream end portion.

A connection pipe 72 is connected to this fuel introduction port. The connection pipe 72 bends generally orthogonally and is connected to a fuel conduit pipe 73 to which fuel is led from the fuel pump. The connection portions 71*fa*, 71*ra*, the fuel supply pipe 71, the connection pipe 72 and the fuel conduit pipe 73 are arranged above the throttle bore 52 and the intake air duct 60, thus, above the throttle passage 52*a*, the assembly passage 61*a* and the branch passages 62*fa*, 62*ra* in the same direction as that of the arrangement of the electric motor 56.

The fuel supply pipe 71 is arranged to come close to the rear bank Br in the perpendicular direction D1 as it extends from the first fuel injection valve 70*f* and the second fuel injection valve 70*r* toward the right, the other direction, in the crank axial direction De, and toward the upstream of fuel flow (see FIG. 3).

The first fuel injection valve 70*f* is disposed close to the cylinder 10*f* of the front bank Bf with respect to the bank central plane Pb. The second fuel injection valve 70*r* is disposed close to the cylinder 10*r* of the rear bank Br with respect to the bank central plane Pb. The first and second fuel injection valves 70*f*, 70*r* are arranged to be offset from each other in the crank axial direction De. The first fuel injection valve 70*f*, the connection portion 71*fa* and the connector 84*f* are arranged more remotely from the electric motor 56, the force-transmitting device 57 and the connector 83 than the second fuel injection valve 70*r*, the connection portion 71*ra* and the connector 84*r*.

Figure 5:
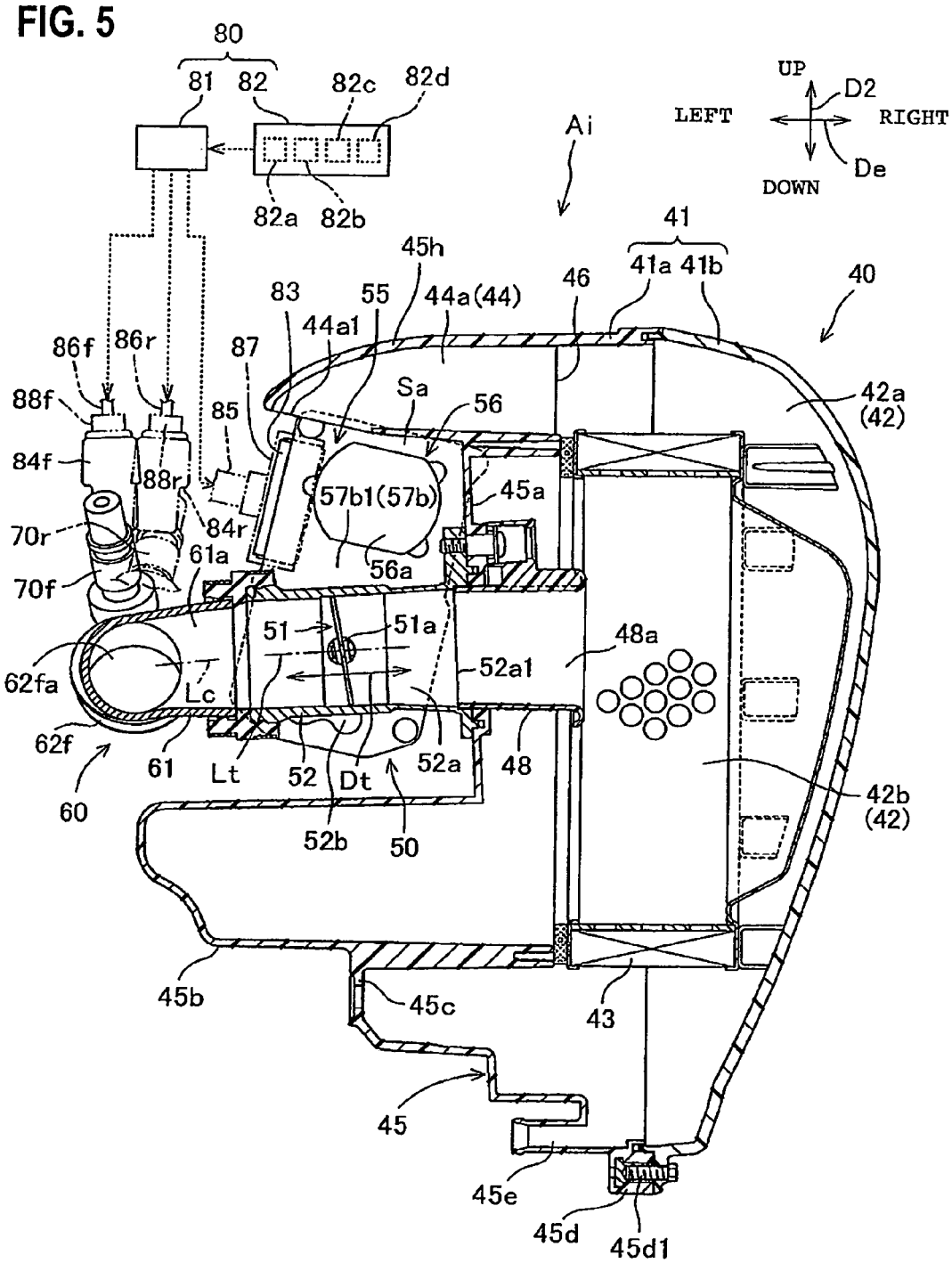
FIG. 5 is a cross-sectional view mainly illustrating the intake apparatus taken along line V-V of FIG. 3.
Figure 6:
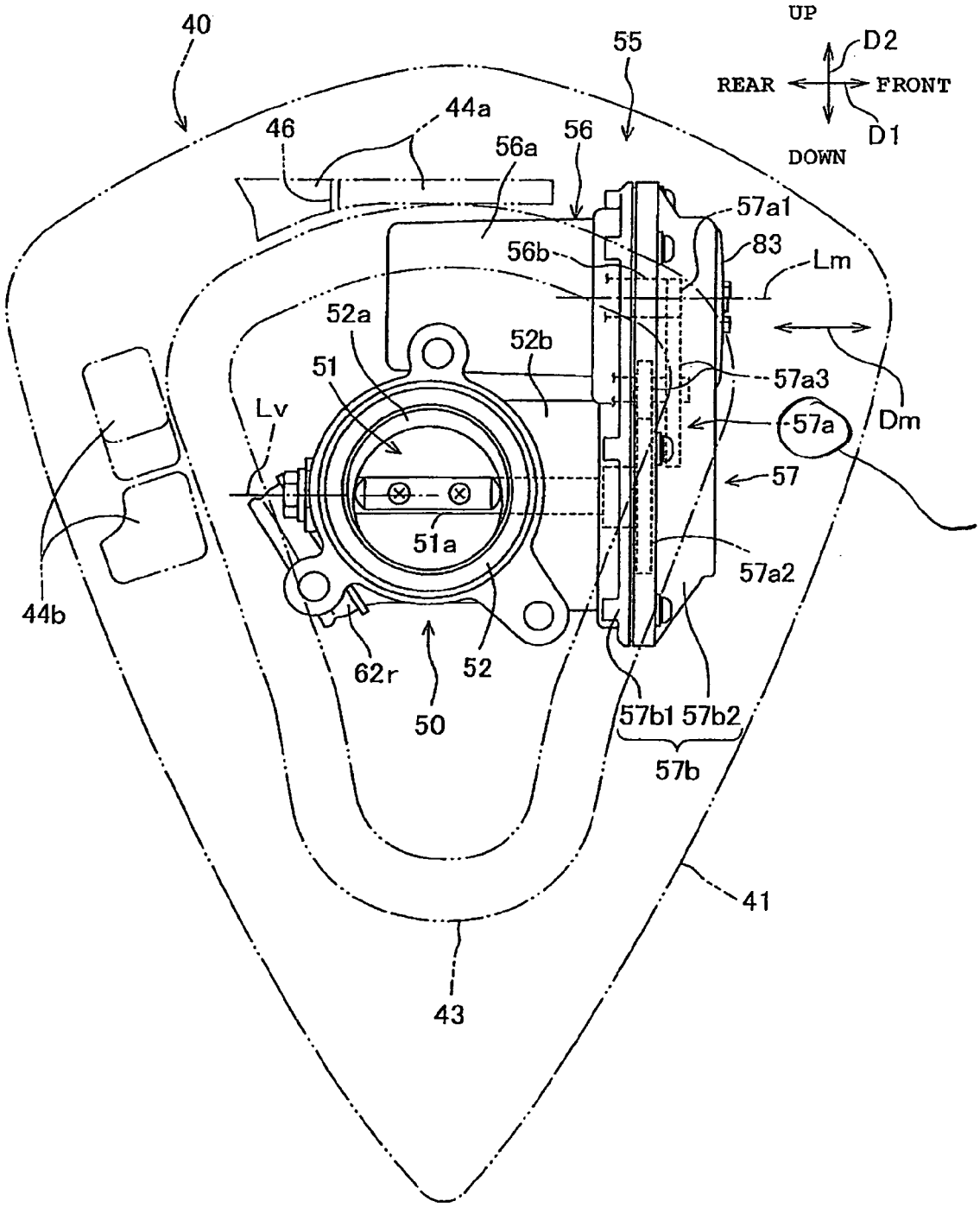
FIG. 6 is a right lateral view mainly illustrating a throttle valve device of the intake apparatus in the engine of FIG. 1.
Figure 7:
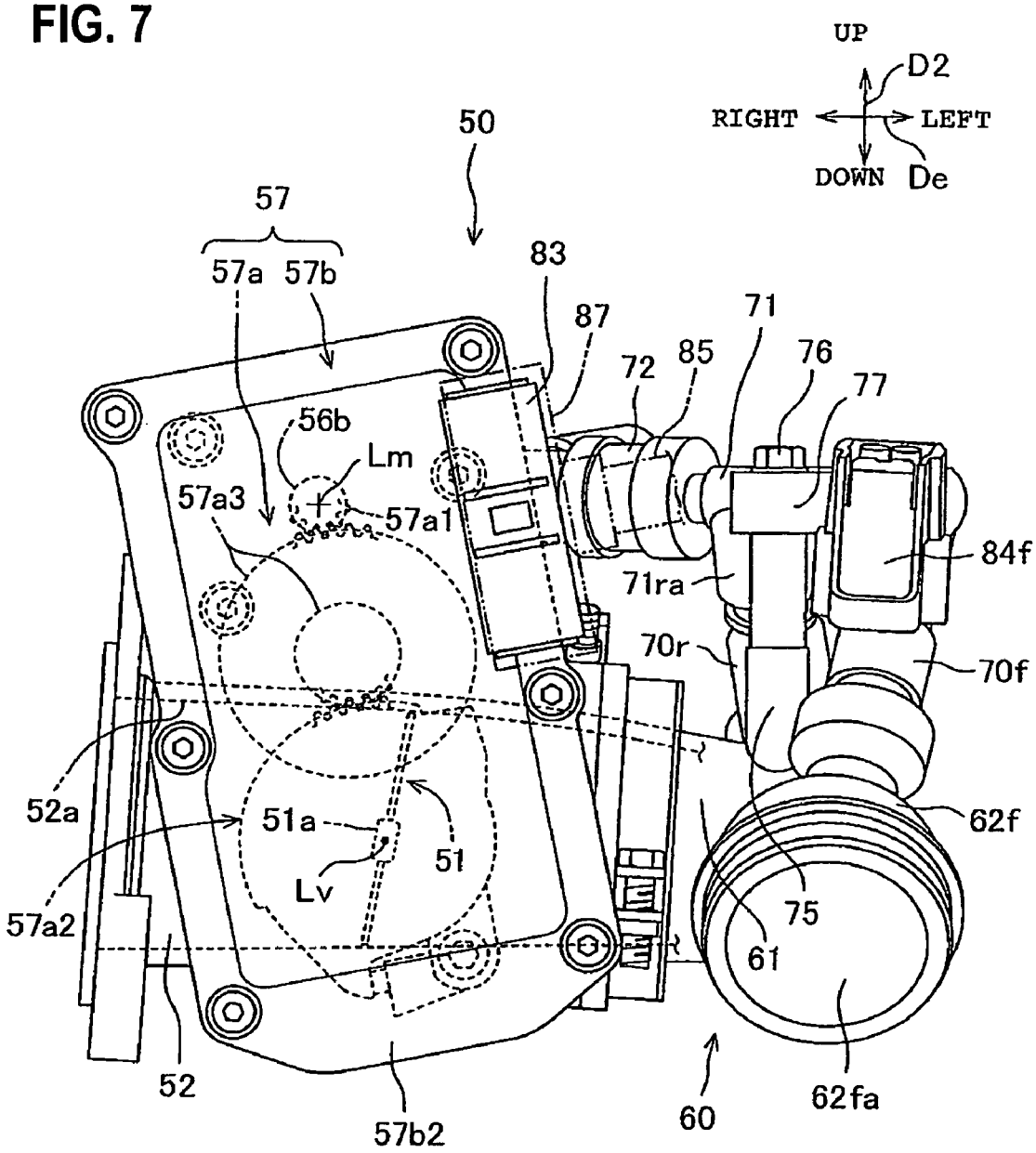
FIG. 7 is a view mainly illustrating the intake apparatus in the engine of FIG. 1 as viewed from the front side.

With reference to FIG. 5, the control device 80 includes an electronic control unit 81 with a microprocessor; and operating condition detecting unit for detecting the engine operating conditions of the internal combustion engine E (see FIG. 1). A signal detected by the operating condition detecting unit is received by the electronic control unit 81.

The electronic control unit 81 includes an engine speed detecting unit 82*a* for detecting engine speed; a load detecting unit 82*b* for detecting an engine load; an accelerator operation amount detecting unit 82*c* for detecting an amount of an accelerator operating member operated by an operator; an opening angle detecting unit 82*d*; and other detecting unit.

The electronic control unit 81 controls the fuel injection valves 70*f*, 70*r*, the electric motor 56 and the like based on the engine operation conditions detected by the operation condition detecting unit 82. In other words, the electronic control unit 81 controls control signals transmitted to the fuel injection valves 70*f* and 70*r* and the electric motor 56 through the wiring harnesses 85, 86*f* and 86*r* connected to the connectors 83, 84*f* and 84*r*, respectively.

With reference to FIGS. 2 through 7, the housing 56*a* of the electric motor 56 is disposed at a position above, immediately above in the embodiment, the throttle bore 52 and the throttle passage 52*a*, and across the bank central plane Pb. The case body 57*b*1 mounted to the front portion of the housing 56*a* is disposed forward of and mounted to the throttle bore 52. Accordingly, the gear train 57*a* and the housing case 57*b* are located at a position overlapping the throttle passage 52*a*, the throttle bore 52 and the housing 56*a* as viewed from the perpendicular direction D1 (see FIGS. 5 and 7) so as to extend from below to above the throttle bore 52 in the up-down direction.

The entire force-transmitting device 57 is disposed close to the front bank Bf with respect to the bank central plane Pb.

In the first case section 41*a*, the case wall 45 provided with the air inlet 44 is a wall on the side where the engine central surface Pe, the throttle valve 51, the intake air duct 60 and the electric motor 56 are located in the crank axial direction De or in the passage centerline direction Dt. In addition, the case wall 45 is a portion of the first case section 41*a* as viewed from the electric motor 56 in the passage centerline direction Dt.

The air inlet 44 is composed of an upper inlet 44*a* as a first inlet located above the throttle bore 52 and the electric motor 56 and a lower inlet 44*b* as a second inlet disposed below and away from the upper inlet 44*a*.

The upper inlet 44*a* extends over both sides of the bank central plane Pb in the perpendicular direction D1. A current plate 46 is disposed in the upper inlet 44*a* so as to extend generally parallel to the passage centerline direction Dt.

The case wall 45 is provided with a cylindrical protruding portion 45*h* which covers over half the housing 56*a*, the general whole of the housing 56*a* in the embodiment, from above in a canopy manner. The protruding portion 45*h* is opposed to the throttle bore 52 in the up-down direction D2 and protrudes from the base 45*a* toward the electric motor 56 in the passage centerline direction Dt. The upper inlet 44*a* provided in the protruding portion 45*h* is obliquely downward opened at an upstream end opening 44*a*1 so as to face the housing 56*a*.

In the upper inlet 44*a*, the upstream end opening 44*a*1 located close to the intake air duct 60 in the passage centerline direction Dt is located at a position overlapping the housing 56*a* as viewed from above.

A space Sa is formed in an up-down range defined between a position of the throttle bore 52 in the up-down direction D2 and a position of the protruding portion 45*h* in the up-down direction D2, between the front bank Bf and the rear bank Br. The space Sa is surrounded by both the banks Bf, Br, the throttle bore 52, and the base 45*a* and protruding portion 45*h* of the case wall 45. Alternatively, the space Sa is surrounded by the housing case 57*b*, the engine head portion Hr of the rear bank Br, the throttle bore 52, the protruding portion 45*h* and the base 45*a*. In general, the entire structure of the housing 56*a* of the electric motor 56 is disposed in the space Sa covered by the protruding portion 45*h* from above.

In addition, the upstream end opening 44*a*1 opens directly above the housing 56*a*. The space Sa is a passage through which outside air flows toward the upper inlet 44*a* during the operation of the internal combustion engine E. The housing 56*a* is exposed to and cooled by the outside air flowing in the space Sa toward the upper inlet 44*a*.

The entire portion of the lower inlet 44*b* is disposed close to the rear bank Br with respect to the bank central plane Pb in the perpendicular direction D1. In addition, the entire portion of the lower inlet 44*b* is provided to extend from above the throttle bore 52 and the throttle passage 52*a* to the same position as those thereof in the up-down direction D2. The lower inlet 44*b* is located at a position, in the passage centerline direction Dt or in the crank axial direction De, opposed to the cylinder head 11*r* and to the head cover 12*r* (see FIG. 2).

As clearly shown in FIG. 3, the gear train 57*a* and the housing case 57*b* are disposed on the side where the front bank Bf is located, with respect to the throttle bore 52, the throttle passage 52*a* and the bank central plane Pb in the perpendicular direction D1. Further, the gear train 57*a*, the housing case 57*b* and the electric motor 56 are disposed at a position opposed to the distant portion 35*fb* of the cylinder head 11*f* and of the head cover 12*f* (i.e., the engine head portion Hf) with respect to the front bank Bf in the perpendicular direction D1.

In addition, they are located at a position opposed to the adjacent portion 35*ra* of the cylinder head 11*r* and of the head cover 12*r* (i.e., the engine head portion Hr) with respect to the rear bank Br in the perpendicular direction D1. Among them, the housing case 57*b* and the distant portion 35*fb* are opposed to each other via only a gap in the perpendicular direction D1.

The entire gear train 57*a* and the entire housing case 57*b*, thus, the entire force-transmitting device 57 and the entire electric motor 56 are disposed on the transmitting portion side (or the right side) opposite to the side where the transmitting mechanism 30*f* of the front bank Bf is located, with respect to the first branch pipe 62*f*, the engine central surface Pe and the first and second cylinder central planes Pf, Pr in the crank axial direction De. The first branch pipe 62*f* is adapted to lead intake air into the cylinder 10*f* defining the first cylinder central plane Pf.

At least a portion, over half in the embodiment, of the gear train 57*a* and of the housing case 57*b*, is disposed between both the banks Bf, Br. Thus, the gear train 57*a* and the housing case 57*b* are located below the uppermost portion of both the banks Bf, Br in the up-down direction D2. Alternatively, the whole of the gear train 57*a* and of the housing case 57*b* may be disposed between a pair of the banks Bf, Br.

Next, described is the function and effect of the illustrative embodiment constituted as described above.

In the V-type internal combustion engine E provided with the front bank Bf and the rear bank Br, the throttle bore 52, electric motor 56 and force-transmitting device 57 of the throttle body 50 are disposed between the pair of banks Bf, Br. The force-transmitting device 57 is disposed close to the front bank Bf with respect to the throttle bore 52 and at a position opposed to the distant portion 35*fb* of the front bank Bf, in the perpendicular direction D1 perpendicular to the bank central plane Pb.

In addition, the force-transmitting device 57 is disposed on the side opposite to the side where the timing mechanism 30*f* is located, with respect to the first cylinder central plane Pf or the branch pipe 62*f* of the intake air duct 60 adapted to lead intake air into the cylinder 10*f* adjacent to the timing mechanism 30*f* in the front bank Bf, in the crank axial direction De. The force-transmitting device 57 for transmitting the drive force of the electric motor 56 to the throttle valve 51 is disposed close to the front bank Bf with respect to the throttle bore 52 in the perpendicular direction D1 and at a position opposed to the distant portion 35*fb* of the front bank Bf in the perpendicular direction D1.

In addition, the force-transmitting device 57 is disposed on the non-transmission portion side which is a side opposite to the side where the timing mechanism 30*f* is located, with respect to the first cylinder central plane Pf or the branch pipe 62*f* connected to the cylinder head 11*f* of the front bank Bf in the crank axial direction De. Thus, the arrangement of the force-transmitting device 57 is not restricted by the adjacent portion 35*fa* and the flexibility of the arrangement of the force-transmitting device 57 in the bank space Sb even increases in the case as below.

In view of the provision of the transmitting mechanism 30*f*, the adjacent portion 35*fa* which is a protruding portion protruding toward the bank central plane Pb is formed on the cylinder head 11*f* and head cover 12*f* of the front bank Bf. As a result, the throttle body 50 in which the throttle bore 52 and the force-transmitting device 57 are disposed in the bank space Sb can compactly be arranged in the up-down direction D2 or in the crank axial direction De. Furthermore, size of the internal combustion engine E can be reduced (downsized) in the up-down direction D2 or in the crank axial direction De.

The throttle bore 52 and the assembly pipe 61 of the intake air duct 60 are disposed to be offset toward the rear bank Br with respect to the bank central plane Pb in the perpendicular direction D1. The throttle bore 52 and the assembly pipe 61 are offset toward the rear bank Br opposite to the front bank Bf opposed to the force-transmitting device 57 with respect to the bank central plane Pb in the perpendicular direction D1.

Thus, the distance between the front bank Bf and the force-transmitting device 57 can be increased in the perpendicular direction D1 according to the offset amount. This can further increase the flexibility of arrangement of the force-transmitting device 57 in the bank space Sb.

As a result, the throttle body 50 can further compactly be arranged in the up-down direction D2 or in the crank axial direction De. Furthermore, the internal combustion engine E can be downsized in the up-down direction D2 or in the crank axial direction De.

In the internal combustion engine E, the electric motor 56 for operating the throttle valve 51 and the first and second fuel injection valves 70*f*, 70*r* are disposed between the front bank Bf and the rear bank Br. The connector 83 of the electric motor 56 and the respective connectors 84*f* and 84*r* of the fuel injection valves 70*f* and 70*r* to which the wiring harnesses 85, 86*f* and 86*r* are respectively connected are disposed above the throttle bore 52 and the intake air duct 60 or above the throttle passage 52*a*, the assembly passage 61*a* and the branch passages 62*fa*, 62*ra*, the wiring harnesses 85, 86*f* and 86*r* being adapted to transmit control signals to the electric motor 56 and the fuel injection valves 70*f* and 70*r*, respectively.

The connectors 83, 84*f*, 84*r* of the electric motor 56 and of the fuel injection valves 70*f*, 70*r* disposed between the pair of banks Bf, Br are disposed above the throttle passage 52*a* or the intake passage. Thus, the connection of the wiring harnesses 85, 86*f*, 86*r* becomes easy which transmit control signals to the electric motor 56 and the fuel injection valves 70*f*, 70*r*, respectively. In addition, the wiring harnesses 85, 86*f*, 86*r* can be reduced in length.

The air cleaner 40 and electric motor 56 of the internal combustion engine E are juxtaposed to each other in the passage centerline direction Dt or in the crank axial direction De. The electric motor 56 is disposed such that the rotational centerline Lm of the rotating shaft 56*b* extends along the passage centerline direction Dt. The air inlet 44 is provided in the case wall 45 close to the electric motor 56 in the passage centerline direction Dt or in the crank axial direction De in the case 41*a* of the air cleaner 40. The electric motor 56 is juxtaposed to the air cleaner 40 in the passage centerline direction Dt of the throttle passage 52*a* or in the crank axial direction De.

In addition, the rotational centerline Lm of the electric motor 56 is arranged to extend in the passage centerline direction Dt or in the crank axial direction De. Thus, the electric motor 56 can compactly be arranged on the periphery of the throttle bore 52 as compared with the case where the rotational centerline Lm and the passage centerline Lt of the throttle passage 52*a* are arranged so as to be misaligned with each other.

Further, an overlapping portion where the electric motor 56 and the case wall 45 overlap each other can be made small as viewed from the passage centerline direction Dt or the crank axial direction De. As a result, restriction of the electric motor 56 can be reduced on the arrangement of the air inlet 44 provided in the case wall 45 close to the electric motor 56 in the passage centerline direction Dt or in the crank axial direction De in the cases 41*a*, 41*b* of the air cleaner 40. This increases the flexibility of arrangement of the air inlet 44 in the case wall 45 to facilitate ensuring a required amount of intake air.

In the V-type internal combustion engine E, even if the throttle bore 52 and the electric motor 56 are arranged between the front bank Bf and the rear bank Br, the electric motor 56 can compactly be arranged on the periphery of the throttle bore 52. Thus, in the V-type internal combustion engine E where the throttle bore 52 and the electric motor 56 are disposed between the pair of banks Bf, Br, the flexibility of arrangement of the air inlet 44 in the case wall 45 can be increased to facilitate ensuring a required amount of intake air.

The first injection valve 70*f* for injecting fuel to intake air directed to the cylinder 10*f* of the front bank Bf and the second injection valve 70*r* for injecting fuel to intake air directed to the cylinder 10*r* of the rear bank Br are arranged on the side of the branch pipes 62*f*, 62*r* of the intake air duct 60, i.e., on the left side as one side in the crank axial direction De with respect to the electric motor 56 and to the force-transmitting device 57 and arranged above the throttle bore 52 and the intake air duct 60, i.e., in the same direction as the electric motor 56.

The fuel supply pipe 71 connected to the first fuel injection valve 70*f* and to the second fuel injection valve 70*r* are arranged to come close to the rear bank Br in the perpendicular direction D1 as it extends rightward in the crank axial direction De from the fuel injection valves 70*f*, 70*r*.

Specifically, the fuel supply pipe 71 extends from the first and second fuel injection valves 70*f*, 70*r* in a direction coming close to the rear bank Br in the perpendicular direction D1. Further, the fuel supply pipe 71 extends in a direction coming close to the rear bank Br opposite to the force-transmitting device 57. Thus, the electric motor 56 and the force-transmitting device 57 arranged between both the banks Bf, Br can be prevented from interfering with the connection between the fuel supply pipe 71 with the first and second fuel injection valves 70*f*, 70*r*, which facilitates the connection work.

Further, the fuel supply pipe 71 connected to the first and second fuel injection valves 70*f*, 70*r* extends from the first and second fuel injection valves 70*f*, 70*r* toward the electric motor 56 and toward the force-transmitting device 57 in the crank axial direction De. Therefore, the fuel supply pipe 71 is inhibited or prevented from projecting from the first and second fuel injection valves 70*f*, 70*r* or from the branch pipes 62*f*, 62*r* in the side opposite to the side where the force-transmitting device 57 is located, in the crank axial direction De. This can compactly arrange the fuel supply pipe 71 in the crank axial direction De.

The upper inlet 44*a* of the air inlet 44 opens, at the upstream end opening 44*a*1, into the space Sa surrounded by the front bank Bf, the rear bank Br, the throttle bore 52 and the case wall 45 of the air cleaner 40. The electric motor 56 is disposed in the space Sa so as to be exposed to the outside air flowing in the space Sa toward the upper inlet 44*a*. The upstream end opening 44*a*1 of the upper inlet 44*a* opens into the space Sa surrounded by the front bank Bf, the rear bank Br, the throttle bore 52 and the case wall 45.

The electric motor 56 is disposed in the space Sa so as to be exposed to the outside air flowing toward the upper inlet 44*a*. Thus, the electric motor 56 is cooled by the outside air flowing in the space Sa toward the upper inlet 44*a*. As a result, the overheating of the electric motor 56 is prevented so that its performance can sufficiently be offered.

A description is hereinafter given of an embodiment resulting from partial modification of the above-described embodiment, particularly, of modified configurations.

If the first cylinder (or the second cylinder) is composed of a plurality of cylinders, the cylinder central plane is a plane including the cylinder axes Lf, Lr of the cylinders adjacent to the timing mechanisms 30*f*, 30*r* in the crank axial direction De.

A first bank and a second bank in claims may be the rear banks Bf, Br and the front banks Bf, Br, respectively. In addition, the first and second banks may be banks other than the front and rear banks, e.g., left and right banks.

The actuator may be an electric actuator or a non-electric actuator other than the electric motor.

The air inlet may be formed from a member (e.g., a duct) other than the case wall 45 and the member may be provided on the case by being attached to the case wall 45. The air inlet may not be composed of the plurality of inlets separated from each other but of a single inlet.

The air inlet device may be a device, other than the air cleaner, not having an air purifying function but being used to simply take in outside air as intake air.

The internal combustion engine may be installed in machines other than vehicles.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A V-type internal combustion engine, comprising:

a hollow crankcase and a crankshaft rotatably disposed in said crankcase;

a first bank and a second bank operatively attached to said crankcase and arranged in a V-shaped profile defining a bank central plane therebetween, the bank central plane being parallel to a rotational centerline of said crankshaft, said bank central plane bisecting a bank angle formed by said first bank and said second bank arranged in said V-shaped profile;

an intake apparatus comprising:

a throttle body including a throttle bore provided with a throttle valve, a throttle actuator for operating the throttle valve, and an intake air routing pipe connected to a cylinder head of the first bank and to a cylinder head of the second bank, and adapted to lead intake air flow controlled by the throttle valve into a first cylinder of the first bank and into a second cylinder of the second bank;

a first valve train system and a second valve train system provided on the cylinder heads of the first bank and the second bank, respectively, for operating an intake valve and an exhaust valve of each of the respective banks; and a first valve train timing mechanism and a second valve train timing mechanism provided on the first bank and the second bank, respectively, for operating the first valve train system and the second valve train system, respectively;

wherein the throttle actuator includes an actuator and a force-transmitting device for transmitting drive force produced by the actuator to the throttle valve;

wherein the throttle body, the actuator and the force-transmitting device are disposed between the first bank and the second bank; and wherein the force-transmitting device is disposed at a position adjacent the first bank with respect to the throttle body, and on a side opposite the first valve train timing mechanism.

2. The V-type internal combustion engine according to claim 1, wherein the throttle body is disposed so as to be offset toward the second bank with respect to the bank central plane.

3. The V-type internal combustion engine according to claim 1, wherein a first fuel injection valve, configured to inject fuel into intake air directed to the first cylinder, and a second fuel injection valve configured to inject fuel to intake air directed to the second cylinder are arranged on one direction side of the crank axial direction with respect to the actuator and in the same direction as the actuator with respect to the throttle body, and a fuel supply pipe, connected to the first fuel injection valve and to the second fuel injection valve, is arranged close to the second bank in the perpendicular direction as the fuel supply pipe extends from the first and second fuel injection valves toward the other direction of the crank axial direction.

4. The V-type internal combustion engine according to claim 2, wherein a first fuel injection valve, configured to inject fuel to intake air directed to the first cylinder, and a second fuel injection valve configured to inject fuel to intake air directed to the second cylinder are arranged on one direction side of the crank axial direction with respect to the actuator and in the same direction as the actuator with respect to the throttle body, and wherein a fuel supply pipe connected to the first fuel injection valve and to the second fuel injection valve is arranged to come close to the second bank in the perpendicular direction as the fuel supply pipe extends from the first and second fuel injection valves toward the other direction of the crank axial direction.

5. The V-type internal combustion engine according to claim 1, wherein:

the intake apparatus includes an air inlet device provided with an air inlet adapted to receive in intake air;

the actuator is an electric motor;

the air inlet opens into a space surrounded by the first bank, the second bank, the throttle body and the air inlet device; and the electric motor is disposed in the space and exposed to outside air flowing in the space toward the air inlet.

6. The V-type internal combustion engine according to claim 2, wherein:

the intake apparatus includes an air inlet device provided with an air inlet adapted to take in intake air;

the actuator is an electric motor;

the air inlet opens into a space surrounded by the first bank, the second bank, the throttle body and the air inlet device; and the electric motor is disposed in the space and exposed to outside air flowing in the space toward the air inlet.

7. The V-type internal combustion engine according to claim 3, wherein:

the intake apparatus includes an air inlet device provided with an air inlet adapted to take in intake air;

the actuator is an electric motor;

the air inlet opens into a space surrounded by the first bank, the second bank, the throttle body and the air inlet device; and the electric motor is disposed in the space and exposed to outside air flowing in the space toward the air inlet.

8. A vehicle comprising a body frame having a V-type internal combustion engine mounted thereon, said V-type internal combustion engine comprising:

a hollow crankcase and a crankshaft rotatably disposed in said crankcase;

a first bank and a second bank operatively attached to said crankcase and arranged in a V-shaped profile defining a bank central plane therebetween, the bank central plane being parallel to a crank axial direction, which is parallel to a rotational centerline of the crankshaft, and said bank central plane bisecting a bank angle formed by said first bank and said second bank arranged in said V-shaped profile;

an intake apparatus comprising:

a throttle valve device including a throttle bore provided with a throttle valve;

a throttle actuator configured to operate the throttle valve; and an intake air routing pipe connected to a cylinder head of the first bank and to a cylinder head of the second bank, and adapted to lead intake air flow controlled by the throttle valve into a first cylinder of the first bank and into a second cylinder of the second bank;

a first valve train system and a second valve train system provided on the respective cylinder heads of the first bank and of the second bank, respectively, to each operate an intake valve and an exhaust valve; and a first valve train timing mechanism and a second valve train timing mechanism provided on the first bank and the second bank, respectively, to drive the first valve train system and the second valve train system, respectively;

wherein the throttle actuator includes an actuator and a force-transmitting device for transmitting drive force produced by the actuator to the throttle valve;

wherein the throttle body, the actuator and the force-transmitting device are disposed between the first bank and the second bank; and wherein the force-transmitting device is disposed at a position on a side of the first bank with respect to the throttle body and opposite the first bank in a direction perpendicular to the bank central plane, and on a side opposite to a side where the first valve train timing mechanism is located with respect to the intake air routing pipe adapted to lead intake air into the first cylinder adjacent to the first valve train timing mechanism in the crank axial direction.

9. A vehicle according to claim 8, wherein the throttle body is disposed so as to be offset toward the second bank with respect to the bank central plane in the perpendicular direction.

10. A vehicle according to claim 8, wherein a first fuel injection valve configured to inject fuel to intake air directed to the first cylinder and a second fuel injection valve configured to inject fuel to intake air directed to the second cylinder are arranged on one direction side of the crank axial direction with respect to the actuator and in the same direction as the actuator with respect to the throttle body, and a fuel supply pipe connected to the first fuel injection valve and to the second fuel injection valve is arranged close to the second bank in the perpendicular direction as the fuel supply pipe extends from the first and second fuel injection valves toward the other direction of the crank axial direction.

11. A vehicle according to claim 9, wherein a first fuel injection valve configured to inject fuel to intake air directed to the first cylinder and a second fuel injection valve configured to inject fuel to intake air directed to the second cylinder are arranged on one direction side of the crank axial direction with respect to the actuator and in the same direction as the actuator with respect to the throttle body, and a fuel supply pipe connected to the first fuel injection valve and to the second fuel injection valve is arranged to come close to the second bank in the perpendicular direction as the fuel supply pipe extends from the first and second fuel injection valves toward the other direction of the crank axial direction.

12. A vehicle according to claim 8, wherein:

the intake apparatus includes an air inlet device provided with an air inlet adapted to receive in intake air;

the actuator is an electric motor;

the air inlet opens into a space surrounded by the first bank, the second bank, the throttle body and the air inlet device; and the electric motor is disposed in the space and exposed to outside air flowing in the space toward the air inlet.

13. A vehicle according to claim 9, wherein:

the intake apparatus includes an air inlet device provided with an air inlet adapted to take in intake air;

the actuator is an electric motor;

the air inlet opens into a space surrounded by the first bank, the second bank, the throttle body and the air inlet device; and the electric motor is disposed in the space and exposed to outside air flowing in the space toward the air inlet.

14. A vehicle according to claim 10, wherein:

the intake apparatus includes an air inlet device provided with an air inlet adapted to take in intake air;

the actuator is an electric motor;

the air inlet opens into a space surrounded by the first bank, the second bank, the throttle body and the air inlet device; and the electric motor is disposed in the space and exposed to outside air flowing in the space toward the air inlet.

15. A V-type internal combustion engine comprising:

a hollow crankcase and a crankshaft rotatably disposed in said crankcase;

a first bank and a second bank operatively attached to said crankcase and arranged in a V-shaped profile defining a bank central plane therebetween, the bank central plane being parallel to a rotational centerline of the crankshaft, the bank central plane bisecting a bank angle;

an electric actuator;

an intake apparatus including a throttle valve device equipped with a throttle body provided with a throttle valve drivingly opened and closed by the electric actuator, and an intake air routing pipe connected to a cylinder head of the first bank and to a cylinder head of the second bank and adapted to lead intake air flow, controlled by the throttle valve, into a first cylinder of the first bank and into a second cylinder of the second bank; and electric fuel injection valves configured to inject fuel to intake air;

wherein the actuator and the fuel injection valves are disposed between the first bank and the second bank, and a connector of the actuator and connectors of the fuel injection valves connected to corresponding wiring harnesses are disposed above an intake passage.

16. The V-type internal combustion engine according to claim 15, further comprising:

a first valve train system and a second valve train system arranged in the first bank and the second bank provided on the respective cylinder heads of the first bank and of the second bank, respectively, to each operate an intake valve and an exhaust valve; and a first valve train timing mechanism and a second valve train timing mechanism provided on the first bank and the second bank, respectively, to drive the first valve train system and the second valve train system, respectively;

wherein the throttle valve device includes a throttle body, the actuator, and a force-transmitting device configured to transmit drive force produced by the actuator to the throttle valve, the throttle body and the force-transmitting device are disposed between the first bank and the second bank, and the force-transmitting device is disposed at a position on a side of the first bank with respect to the throttle body and opposite the first bank in a direction perpendicular to the bank central direction, and on a side opposite to a side where the first valve train timing mechanism is located with respect to the intake air routing pipe adapted to lead intake air into the first cylinder adjacent to the first valve train timing mechanism in the crank axial direction.

17. The V-type internal combustion engine according to claim 16, wherein the throttle body is disposed to be offset toward the second bank with respect to the bank central plane in the perpendicular direction.

18. The V-type internal combustion engine according to claim 16, wherein:

the fuel injection valves comprise a first fuel injection valve configured to inject fuel to intake air directed to the first cylinder, and a second fuel injection valve configured to inject fuel to intake air directed to the second cylinder, the first and second fuel injection valves are arranged on one direction side of the crank axial direction with respect to the actuator and in the same direction as the actuator with respect to the throttle body, and a fuel supply pipe connected to the first fuel injection valve and to the second fuel injection valve is arranged to come close to the second bank in the perpendicular direction as the fuel supply pipe extends from the first and second fuel injection valves toward the other direction of the crank axial direction.

19. The V-type internal combustion engine according to claim 17, wherein the fuel injection valves comprise a first fuel injection valve configured to inject fuel to intake air directed to the first cylinder, and a second fuel injection valve configured to inject fuel to intake air directed to the second cylinder, the first and second fuel injection valves are arranged on one direction side of the crank axial direction with respect to the actuator and in the same direction as the actuator with respect to the throttle body, and a fuel supply pipe connected to the first fuel injection valve and to the second fuel injection valve is arranged to come close to the second bank in the perpendicular direction as the fuel supply pipe extends from the first and second fuel injection valves toward the other direction of the crank axial direction.

20. The V-type internal combustion engine according to claim 15, wherein each of said first bank and said second bank includes a plurality of cylinders.

* * * * *